US005875228A

United States Patent [19]

Truszkowska

[11] Patent Number: 5,875,228

[45] Date of Patent: Feb. 23, 1999

[54] LIGHTWEIGHT ROTATING ANODE FOR X-RAY TUBE

[75] Inventor: Krystyna Truszkowska, Milwaukee, Wis.

[73] Assignee: General Electric Company, Milwaukee, Wis.

[21] Appl. No.: 881,405

[22] Filed: Jun. 24, 1997

[51] Int. Cl.[6] ..... H01J 35/10

[52] U.S. Cl. ..... 378/144; 378/143

[58] Field of Search ..... 378/143, 144

[56] References Cited

U.S. PATENT DOCUMENTS 4,119,261 10/1978 Devine, Jr. .
4,129,241 12/1978 Devine, Jr. .
4,847,883 7/1989 Fourre ..... 378/143 X
4,958,364 9/1990 Guerin et al. ..... 378/143 X
5,138,645 8/1992 Penato et al. ..... 378/144

*Primary Examiner*—David P. Porta
*Attorney, Agent, or Firm*—B. Joan Haushalter; Phyllis Y. Price

[57] ABSTRACT

A rotating anode structure for an X-ray tube is provided, having a lightweight target anode. A carbon-carbon composite target substrate has constituents and weave geometries. A refractory metal focal track layer is deposited on the substrate to produce X-rays. An interlayer is disposed between the focal track layer and the substrate to relieve thermal expansion mismatch stresses between the carbon-carbon composite anode target substrate and the refractory metal focal track layer. The interlayer is a rhenium interlayer and the focal track layer is typically a tungsten-rhenium focal track layer.

11 Claims, 1 Drawing Sheet

LIGHTWEIGHT ROTATING ANODE FOR X-RAY TUBE

TECHNICAL FIELD

The present invention relates to X-ray tubes and, more particularly, to a carbon-carbon composite and coating therefor for X-ray rotating anode assemblies.

BACKGROUND ART

The X-ray tube has become essential in medical diagnostic imaging, medical therapy, and various medical testing and material analysis industries. Typical X-ray tubes are built with a rotating anode structure for the purpose of distributing the heat generated at the focal spot. The anode is rotated by an induction motor comprising a cylindrical rotor built into a cantilevered axle that supports the disc shaped anode target, and an iron stator structure with copper windings that surrounds the elongated neck of the X-ray tube that contains the rotor. The rotor of the rotating anode assembly being driven by the stator which surrounds the rotor of the anode assembly is at anodic potential while the stator is referenced electrically to ground. The X-ray tube cathode provides a focused electron beam which is accelerated across the anode-to-cathode vacuum gap and produces X-rays upon impact with the anode.

In an X-ray tube device with a rotatable anode, the target typically comprises a disk made of a refractory metal such as tungsten, and the X-rays are generated by making the electron beam collide with this target, while the target is being rotated at high speed. High speed rotating anodes can reach 9,000 to 11,000 RPM. Rotation of the target is achieved by driving the rotor provided on a support shaft extending from the target.

Operating conditions for X-ray tubes have changed considerably in the last two decades. U.S. Pat. No. 4,119,261, issued Oct. 10, 1978, and U.S. Pat. No. 4,129,241, issued Dec. 12, 1978, were both devoted to joining rotating anodes made from molybdenum and molybdenum-tungsten alloys to stems made from columbium and its alloys. Continuing increases in applied energy during tube operation have led to a change in target composition to TZM or other molybdenum alloys, to increased target diameter and weight, as well as to the use of graphite as a heat sink in the back of the target. Future computerized tomography (CT) scanners will be capable of decreasing scan time from a one second rotation to a 0.5 second rotation or lower. However, such a decrease in scan time will quite possibly require a modification of the current CT anode design. The current CT anode design comprises two disks, one of a high head storage material such as graphite, and the second of a molybdenum alloy such as TZM. These two concentric disks are bonded together by means of a brazing process. A thin layer of refractory metal such as tungsten or tungsten alloy is deposited to form a focal track. Such a composite substrate structure may weigh in excess of 4 kg. With faster scanner rotation rates, heavy targets will increase not only mechanical stress on the bearing materials but also a focal spot sag motion causing image artifacts.

It would be desirable then to replace the present CT target design with a lightweight design comparable in thermal performance, particularly suited for use in X-ray rotating anode assemblies.

SUMMARY OF THE INVENTION

The present invention provides for a lightweight target anode made of carbonaceous materials and a refractory metal focal track coating for use in CT scanners. Carbon-carbon composite substrates for an X-ray rotating anode are provided, replacing graphite in previous systems, having constituents and weave geometries that result in relatively high thermal expansion in the in-plane direction to accept the focal track material, high thermal conductivity through the thickness to meet focal track loadability requirements, and high mechanical strength to sustain rotational stresses. The present invention provides for a coating capable of joining the refractory metal of the focal track with the carbon-carbon composite x-ray anodes, to relieve thermal expansion mismatch stresses between the refractory and carbonaceous materials.

In accordance with one aspect of the present invention, a rotating anode structure for an X-ray tube is provided, having a lightweight target anode. A carbon-carbon composite target substrate has constituents and weave geometries. A refractory metal focal track layer is deposited on the substrate to produce X-rays. An interlayer is disposed between the focal track layer and the substrate to relieve thermal expansion mismatch stresses between the carbon-carbon composite anode target substrate and the refractory metal focal track layer. The interlayer is a rhenium interlayer and the focal track layer is typically a tungsten-rhenium focal track layer.

Accordingly, it is an object of the present invention to provide a carbon-carbon composite material for a CT rotating anode. It is a further object of the present invention to provide a focal track interlayer system for joining the carbon-carbon composite material to a refractory metal focal track. It is a yet another object of the present invention to provide such a composite having constituents and weave geometries that result in relatively high thermal expansion in the in-plane direction, to accept the focal track material. It is still another object of the present invention to provide such a composite having constituents and weave geometries that result in relatively high thermal conductivity through the thickness to meet focal track loadability requirements. Finally, it is an object of the present invention to provide such a focal track layer system capable of accommodating tensile overstress and reducing microcracking.

Other objects and advantages of the invention will be apparent from the following description, the accompanying drawings and the appended claims.

DETAILED DESCRIPTION OF THE PREFERRED EMBODIMENTS

The present invention relates to X-ray tubes which employ a rotating anode assembly and a cathode assembly. The purpose of this invention is to provide a lightweight rotating anode, capable of accommodating faster scanner rotation rates. The lightweight target anode is preferably comprised of carbonaceous materials, such as carbon-carbon composites, and is a potential candidate to replace the relatively heavy brazed graphite anode design in current and future CT scanner systems. Carbonaceous material targets have at least comparable thermal performance, while achieving significant weight reduction, as compared to existing tube target products.

Figure 1:
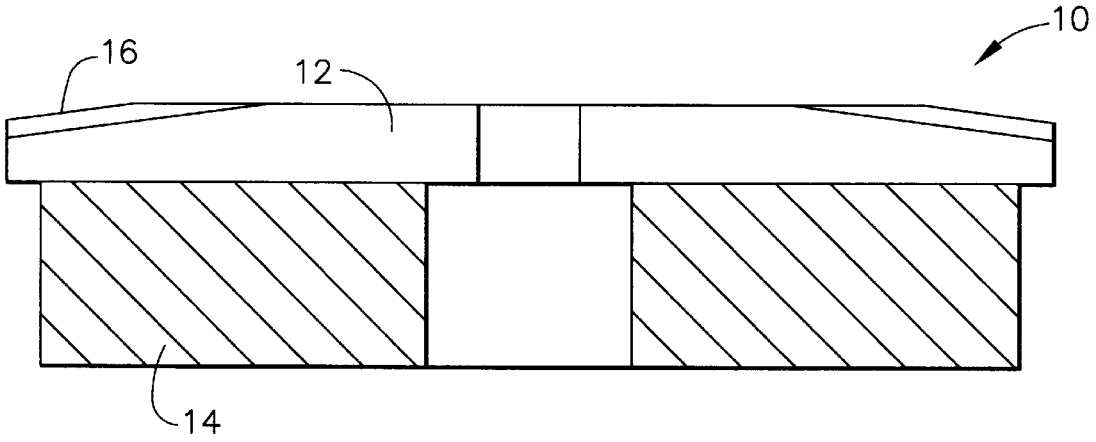
FIG. 1 (PRIOR ART)
FIG. 1 is a prior art cross-sectional illustration of a CT anode target.

Referring now to the drawings, FIG. 1 illustrates a typical prior art CT anode target 10. The current CT anode 10 design comprises two disks 12 and 14. One disk 14 is of a high head storage material such as graphite, and the second disk 12 is of a molybdenum alloy such as TZM. These two concentric disks are bonded together by means of a brazing process. A thin layer of refractory metal such as tungsten or tungsten alloy is deposited to form a focal track 16. Such a composite substrate structure may weigh in excess of 4 kg. With faster scanner rotation rates, heavy targets will increase not only mechanical stress on the bearing materials but also a focal spot sag motion causing image artifacts.

The present invention proposes tailored woven carbon-carbon composite structures or reinforced carbon-carbon composite felts, to replace the graphite material in existing CT scanner systems. Carbonaceous materials already have desirable thermal and mechanical properties for X-ray applications, such as high strength-to-weight ratio, strength retention and creep resistance over a wide temperature range, resistance to thermal shock, high toughness and high thermal conductivity. These properties are important in the CT anode design. The present invention proposes the use of weaving processes and technologies, well known in the art, applied to the carbonaceous material, to achieve lightweight anode structures.

The through-the-thickness high conductivity of the carbonaceous substrate of the present invention is accomplished by a high fiber volume fraction of high strength and high modules fibers. Suitable materials include, for example, Amoco P-120 or K-1100 pitch based products. Vapor grown carbon fiber (VGCF) with thermal conductivity in excess of 1500 W/m K, high strength and stiffness, is one alternative material for the z-direction reinforcement.

In the in-plane direction, the carbon-carbon composite is weaved using a low conductivity, low modulus fiber. Rayon precursor materials such as continuous fibers or fabrics are of relatively low strength, elastic modules, and thermal properties. These are typically parameters which result in a relatively high thermal expansion carbonaceous material.

For CT applications, the carbon-carbon composite material is treated and provided with the proper volume of fibers to achieve at least the same thermal performance as brazed graphite. Fiber is weaved in the Z-direction, densified and heat treated, to achieve at least two times higher conductivity than that of graphite in the Z-direction, and an in-plane conductivity equal to or greater than that of graphite, using treating and weaving processes well known in the art.

In order to secure the deployment of carbon-carbon composite in X-ray tube application, the development of an adherent, long life focal track system is required. Carbon-carbon composites, including tailored woven structures and carbon fiber felts, have a lower coefficient of thermal expansion (CTE) than focal track materials of refractory metals. The thermal expansion mismatch between the carbon-carbon composite substrate and the target focal track can result in severe processing or service stresses and subsequent focal track layer spallation. Consequently, existing focal track coating processes, while suitable for use with graphite anodes, are not capable of relieving the thermal expansion mismatch stresses between carbonaceous and refractory materials.

The present invention proposes a focal track coating system which allows carbon-carbon composites to replace graphite materials in a CT anode structure, which can accommodate faster scanner rotation rates.

Figure 2:
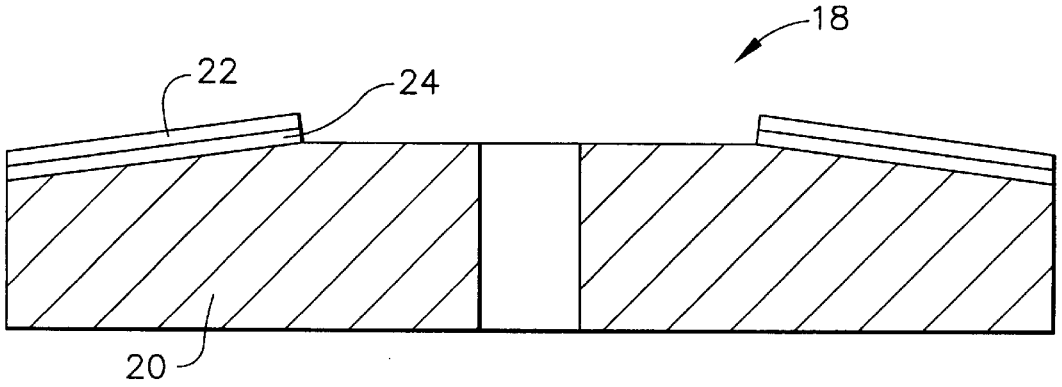
FIG. 2 is a cross-sectional illustration of a CT anode target according to the present invention.

In accordance with the present invention, the present target design of FIG. 1 is replaced by a lighter weight substrate which is comparable in thermal performance to the present target. FIG. 2 is a cross-sectional illustration of a CT anode target 18 constructed according to the present invention. Graphite material is known to have high heat storage capacity and low density. Unfortunately, it has proven to be inadequate for larger diameter targets. Due to the low mechanical strength of graphite, larger diameter targets tend to burst under the effect of centrifugal force.

In accordance with the present invention, therefore, other carbonaceous materials, such as carbon-carbon composites are provided to replace the present CT anode targets 10. As described above, these multi-directional carbon-carbon composites are tailored with thermophysical and mechanical properties, to increase their expansion coefficient in the in-plane direction and provide high thermal conductivity through the thickness.

In FIG. 2, the anode target 18 is comprised of such a carbon-carbon composite 20. A thin layer of refractory metal such as tungsten or tungsten alloy, including tungsten-rhenium, is deposited to form a focal track 22. The preferred thickness of the refractory metal layer 22 is in a range of 200 to 500 $\mu$m and its composition comprises 5–10% rhenium. To relieve thermal expansion mismatch stresses between the carbonaceous material 20 and the refractory metal of the focal track 22, the anode target 18 further comprises an interlayer 24. The interlayer 24 provides ductile transition between the carbonaceous material 20 and the focal track 22.

In a preferred embodiment of the present invention, the interlayer 24 comprises a rhenium interlayer, capable of providing high ductility, particularly when the interlayer is a thick interlayer, significantly greater than 10 $\mu$m. In a further preferred embodiment of the present invention, the thickness of the rhenium interlayer is desired to be about 50–100 $\mu$m. This relatively thick ductile interlayer is able to accommodate tensile overstress due to thermal expansion mismatch with the substrate on cooling from the deposition temperature and to reduce microcracking of the focal track coating system during thermal cycling.

An adherent focal track layer system on carbon-carbon composite materials is formed by any suitable method, such as low pressure plasma spraying (LPPS), chemical vapor deposition (CVD), or other satisfactory methods. However, in a preferred embodiment of this invention, LPPS is method for forming the adherent focal track layers, which layers comprise the top layer (typically tungsten-rhenium) and the interlayer (preferably rhenium). Chemical vapor deposition has a tendency to produce highly dense coatings. Simulated electron beam testing on CVD coated carbon-carbon composite specimens has demonstrated that these highly dense CVD coatings do not accommodate the thermomechanical stresses produced during thermal cycling, and suffer some degradation of the interface between the rhenium interlayer and the top layer. In contrast, LPPS coatings with a controlled porosity level below 2% not only outperform the CVD coatings under identical thermal cycling conditions, but are capable of withstanding the same thermal load as the existing graphite targets.

In accordance with the present invention, a carbonaceous material is proposed for use in constructing lightweight rotating anode structures for X-ray tubes. Further, a focal track coating system is provided for such carbonaceous composite x-ray anodes, capable of relieving thermal expansion mismatch stresses between the carbonaceous material of the anode and the refractory metal of the focal track. The focal track layer system of the present invention proposes a double layer structure comprising a fine grained rhenium interlayer and a fine grained top layer made of tungsten-rhenium alloy.

It will be obvious to those skilled in the art that various modifications and variations of the present invention are possible without departing from the scope of the invention, which provides carbon-carbon composites for CT targets. The carbon-carbon composite targets fabricated in accordance with the present invention have comparable or better thermal performance and 50% weight reduction, as compared to existing CT tube target products.

The invention has been described in detail with particular reference to certain preferred embodiments thereof, but it will be understood that modifications and variations can be effected within the spirit and scope of the invention.

What is claimed is:

1. A rotating anode structure for an X-ray tube comprising:

a target substrate formed entirely of a carbon-carbon composite material, the carbon-carbon composite target substrate having a through-the-thickness high conductivity and an in-plane direction weave;

a refractory metal focal track layer deposited on the substrate to produce X-rays; and an interlayer disposed between the focal track layer and the substrate.

2. A rotating anode structure as claimed in claim 1 wherein the interlayer comprises a rhenium interlayer.

3. A rotating anode structure as claimed in claim 2 wherein the focal track layer comprises a tungsten-rhenium focal track layer.

4. A rotating anode structure as claimed in claim 3 wherein the rhenium interlayer relieves thermal expansion mismatch stresses between the carbon-carbon composite anode target and the refractory metal focal track layer.

5. A rotating anode structure as claimed in claim 2 wherein the rhenium interlayer is applied using low pressure plasma spraying.

6. A rotating anode structure as claimed in claim 2 wherein the rhenium interlayer has a thickness in the range of fifty to one hundred $\mu$m.

7. A rotating anode structure as claimed in claim 3 wherein the tungsten-rhenium focal track layer has a thickness in the range of two hundred to five hundred $\mu$m.

8. A rotating anode structure as claimed in claim 3 wherein the tungsten-rhenium focal track layer comprises five to ten percent rhenium.

9. A rotating anode structure as claimed in claim 1 wherein the carbon-carbon composite anode target is processed to increase thermal conductivity and expansion coefficient.

10. A rotating anode structure as claimed in claim 1 wherein the through-the-thickness high conductivity of the carbon-carbon composite target substrate is achieved by a high fiber volume fraction of high strength and high module fibers.

11. A rotating anode structure as claimed in claim 1 wherein the in-plane direction weave comprises a low conductivity, low modulus finer weave.

* * * * *